US005215028A

United States Patent [19]

Hayakawa

[11] Patent Number: 5,215,028

[45] Date of Patent: Jun. 1, 1993

[54] FLOATING STRUCTURES

[75] Inventor: Yasuhiro Hayakawa, Akishima, Japan

[73] Assignees: Tomoe Kogyo K.K.; K.K. Rosso; Aoi Plastic K.K., all of Tokyo, Japan

[21] Appl. No.: 876,538

[22] Filed: Apr. 30, 1992

[30] Foreign Application Priority Data

Sep. 30, 1991 [JP] Japan ..... 3-276341

[51] Int. Cl.[5] ..... B63B 35/44

[52] U.S. Cl. ..... 114/267

[58] Field of Search ..... 114/258, 259, 260, 265, 114/264, 266, 267

[56] References Cited

U.S. PATENT DOCUMENTS

| | | | |
|---|---|---|---|
| 3,777,689 | 12/1973 | Olsen et al. | 114/267 |
| 3,925,991 | 12/1975 | Poche | 114/267 |
| 3,951,085 | 4/1976 | Johnson et al. | 114/267 |
| 4,085,696 | 4/1978 | Shorter | 114/267 |

*Primary Examiner*—Jesûs D. Sotelo
*Assistant Examiner*—Stephen P. Avila
*Attorney, Agent, or Firm*—Sprung Horn Kramer & Woods

[57] ABSTRACT

A floating structure which comprises (a) a plurality of floats, each having a flat, polygonal or irregularly polygonal shape, with the upper and lower half parts staggered horizontally a given distance relative to each other, at least one edge forming an overhanging upper extension and the opposite edge a steplike lower extension, said upper and lower extensions being formed with connecting holes which, when the float is arranged to overlap with floats of the same construction in a mutually complementary manner, come in alignment with connecting holes of the lower and upper extensions of the neighboring floats so that said connecting pins are inserted through the aligned holes, and (b) connecting pins adapted to be fitted into the connecting holes formed in the floats.

4 Claims, 3 Drawing Sheets

FIG. 4
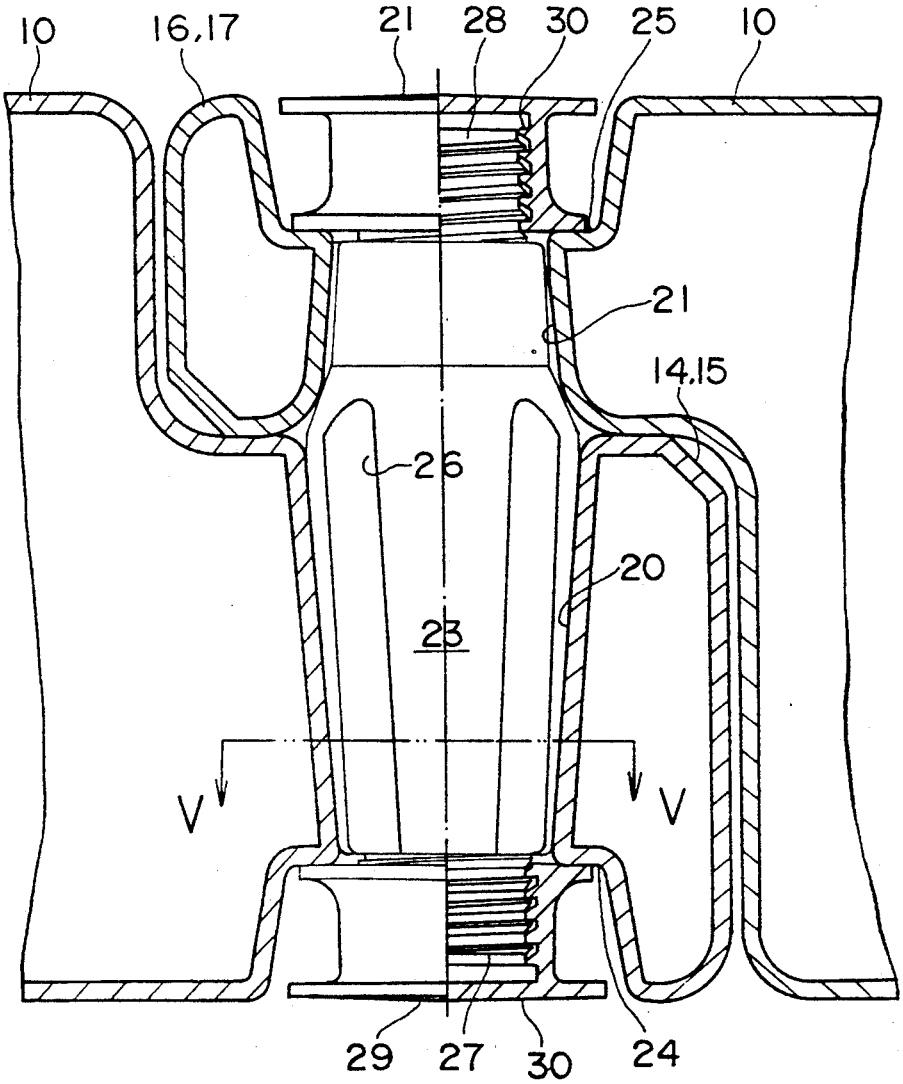
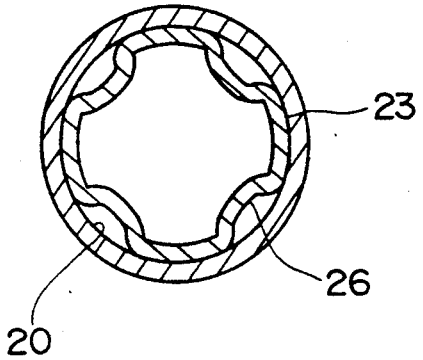
FIG. 5

FLOATING STRUCTURES

BACKGROUND OF THE INVENTION

This invention relates to floating structures for use as waterborne leisure lands (artificial floating islands), floating piers and the like and also relates to unitary floats to be assembled into those structures.

Conventional floating structures are roughly divided into two; large structures of unitary construction and structures consisting of a number of small floats joined together. The latter structures are preferable because they are easier to manufacture and handle, e.g., in transportation and assembling. The floating units are joined by connector means in such manner that they are not disjoined by the action of wind or waves or by variation of loads they support and also that the vertical movements of the individual units are minimized. Usually eye plates are attached to the edges of the units for interconnection by means of bolts and nuts, chains, ropes, etc., or long iron bars are passed through a plurality of floats to interlock them together. A further alternative has been to unite the units with rubber belts. The joining means of eye plate-bolt-nut combination normally involve partial projections from the edges of the floats, providing considerable spaces among the adjacent units. This makes the assembly unable to maintain stability with irregular or ununiform loads. One recent approach to the problem is to form recesses in edges of floats and fix eye plates within the recesses. Interlocking with iron bars produces such an integrity that the assembly cannot be bodily hauled up from the water. Once the bars are pulled off, the units are difficult to reassemble. The disadvantage of the eyelet and rubber belt joints is that the parts are repeatedly subjected to varying loads due to vertical motion of the floats with waves and changes in loads and are eventually broken down.

In an effort to overcome these problems of the prior art, I proposed a floating structure and unit floats for assembly into the structure in Japanese Patent Application Public Disclosure (Kokai) No. 216386/1990. Products made in conformity with the embodiments described in the published specification have come into practical use. The invention remedied many of the shortcomings of the prior art floats and provided a floating structure easy to assemble and stable as assembled. The construction of the float disclosed in the specification will now be described with reference to FIGS. 1 and 3. As shown specifically in FIGS. 2 and 3, a plurality of floats 10, 10 of the same construction are formed from plastics, e.g., polyethylene. They are stepped so that they are mutually complementary in shape when arranged closely side by side and end to end. To be more exact, steplike lower extensions 14, 15 of each float 10 and overhanging upper extensions 16, 17 of each adjacent float 10 are superposed, as in FIGS. 1 and 2, with upright connecting posts 11 formed in one piece with the lower extensions inserted into corresponding connecting holes 19 formed in the upper extensions and fastened in place with bolts 13 threadedly engaged with nuts 18, or internally threaded portions of the connecting posts 11. The horizontal and vertical planes of the steplike configurations permit horizontal and vertical dispersion of the stresses resulting from the external forces due to vertical, horizontal, and other motions of the floats. Thus, the stress concentrations in the connections are substantially reduced and the stability of the assembled floating structure is enhanced. Given some allowances at the connections, the assembly can smoothly ride on the waves, even billows, with the overall stress concentration decreased to some extent.

However, the structure, in which the connecting posts 11 for joining use are molded in one piece with the float body from the same resin material, presents a problem. While the assembled structure is in use, the waving water surface causes the individual floats to drift toward and away from one another, with the result that stresses are repeatedly concentrated in the roots of the connecting posts. Experiments have revealed that this leads to cracking or breaking of the posts after long time service, necessitating the replacement of the entire float assembly even though the other parts are sound enough for continued use.

Another problem arises from the use of such a floating structure in a shallow water such as sandbank (e.g., about three meters deep). Sand then gains entrance into the gaps between the overlapping parts of the individual floats and abrades the roots of the connecting posts 11 rapidly with the aid of the changing load due to the incessant undulation of the water surface.

SUMMARY OF THE INVENTION

Therefore, it is the primary object of this invention to provide a float and a floating structure as an assembly of a plurality of the floats, of the type described in Patent Application Public Disclosure No. 216386/1990, in which the stress concentrations in the connectors are minimized.

Another object of the invention is to provide a floating structure which is protected against abrasion with sand when used in shallow waters.

The present invention solves the foregoing problems of the prior art by providing a floating structure which comprises (a) a plurality of floats, each having a flat, polygonal or irregularly polygonal shape, with the upper and lower half parts staggered horizontally a given distance relative to each other, at least one edge forming an overhanging upper extension and the opposite edge a steplike lower extension, said upper and lower extensions being formed with connecting holes which, when the float is arranged to overlap with floats of the same construction in a mutually complementary manner, come in alignment with connecting holes of the lower and upper extensions of the neighboring floats so that said connecting pins are inserted through the aligned holes, and (b) connecting pins adapted to be fitted into the connecting holes formed in the floats.

In preferred embodiments of the invention, the individual floats constituting a floating structure have connecting holes and connecting posts at least either of which are formed with a plurality of axially extending sand-escape grooves each.

BRIEF DESCRIPTION OF THE DRAWINGS

FIG. 4 is a fragmentary cross sectional view of a floating structure embodying the invention; and FIG. 5 is a sectional view taken along the line V—V of FIG. 4.

DESCRIPTION OF THE PREFERRED EMBODIMENTS

An embodiment of the invention will now be fully described with reference to the accompanying drawings.

Figure 1:
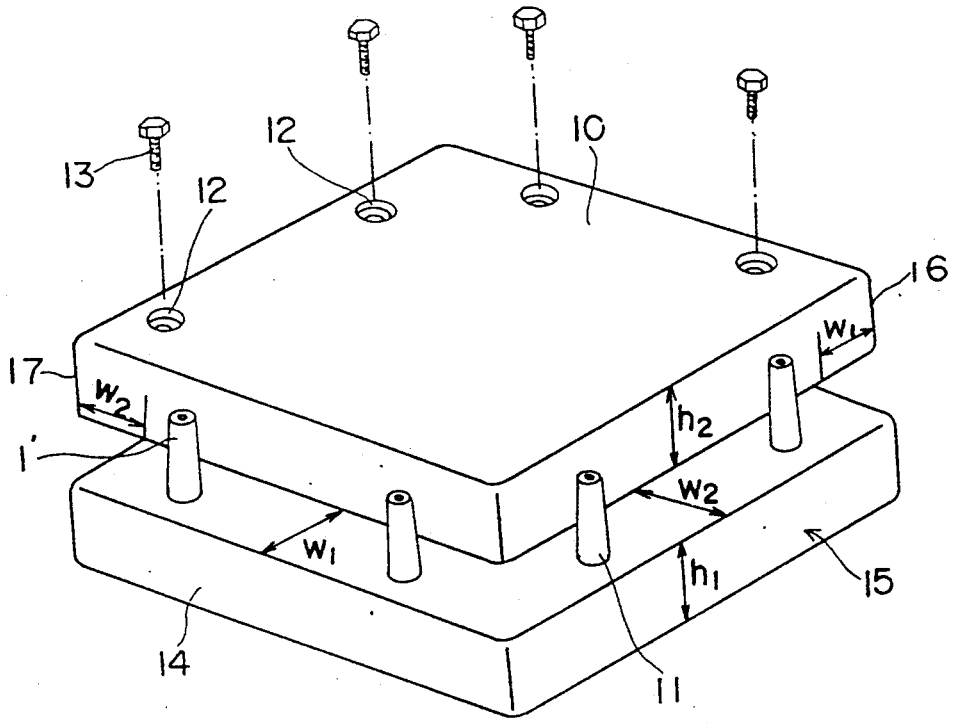
FIG. 1 PRIOR ART
FIG. 1 is a perspective view of a conventional float.
Figure 2:
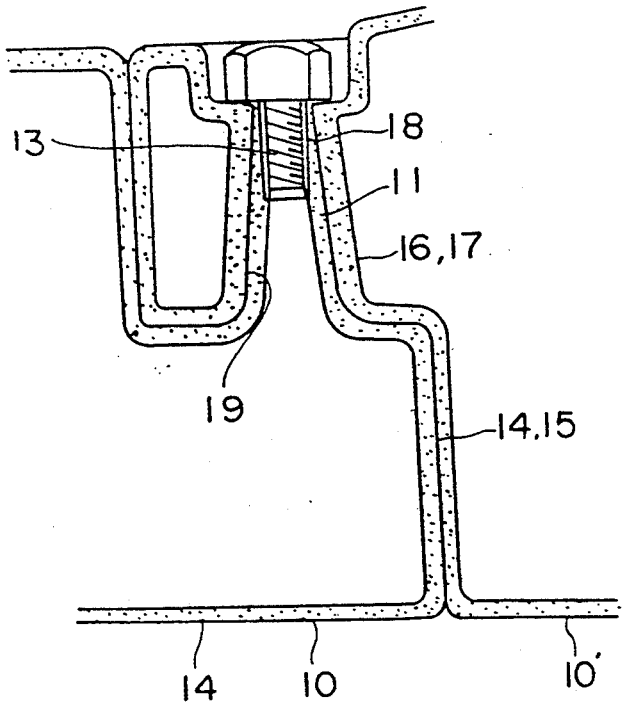
FIG. 2 PRIOR ART
FIG. 2 is a fragmentary cross sectional view of two conventional floats assembled together.
Figure 3:
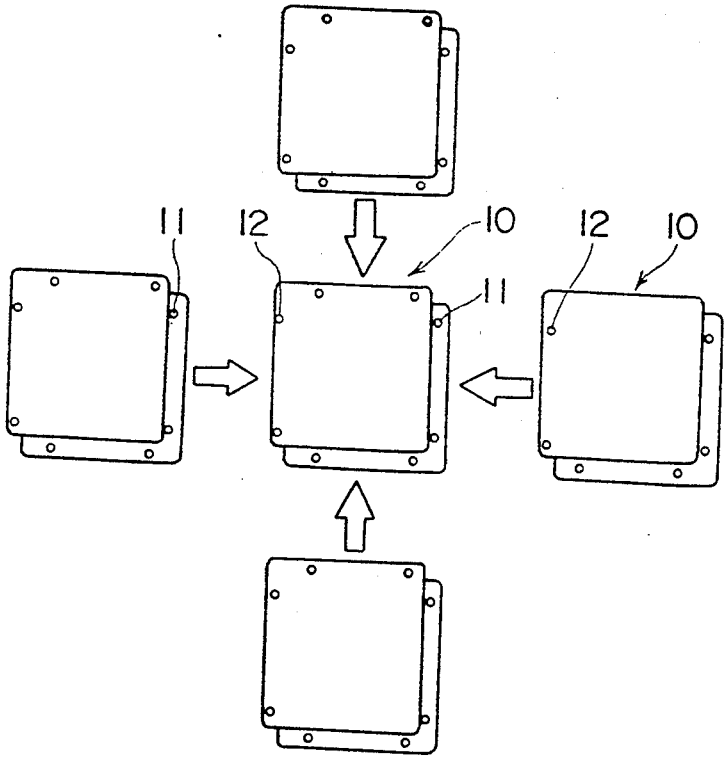
FIG. 3 PRIOR ART
FIG. 3 is a plan view of a plurality of conventional floats being assembled into a floating structure.

The float according to the present invention is similar in fundamental construction to the prior art structure illustrated in FIGS. 1 to 3 but differs greatly in connector means. The parts other than the connector means, therefore, are hereinafter mentioned only when needed; for their details, reference should be made to the published specification of the above-mentioned patent application. The parts of the float according to the invention like those of the conventional structure are given below, with numerals like those used in FIGS. 1 to 3. Turning to FIGS. 1 and 2, the float 10 of a construction like a staggered arrangement of two flat boards, regular square in a plan view (other shapes being possible as indicated in the cited specification), consists of a hollow body molded of a resin such as polyethylene, preferably crosslinked polyethylene. Two contiguous edges of the float body 10 have steplike lower extensions 14, 15, respectively, projecting by given horizontal dimensions $w_1$, $w_2$ and having a common height $h_1$. The other two contiguous edges have upper extensions 16, 17, respectively, overhanging by $w_1$, $w_2$ and having a common height $h_2$. The dimensions $w_1$ and $w_2$ may be different but preferably are the same. The dimensions $h_1$ and $h_2$ may be different or the same. Combining two adjacent floats is made easy by the use of the same dimension for $w_1$ and $w_2$.

Next, the features of the present invention will be clarified in conjunction with FIGS. 4 and 5. All members are preferably built of the same material, e.g., crosslinked polyethylene. Connecting pins to be described below must not be made of metal, because the resin parts of the float subject to undulation could crack prematurely under severe stresses from the metallic members. As shown in FIG. 4, steplike lower extensions 14, 15 are formed with vertical through holes 20 for connection use, which are preferably tapered downwards to facilitate the insertion of connecting pins 23. Overhanging upper extensions 16, 17 have connecting holes 21 formed vertically in alignment with the connecting holes 20, preferably with a back taper or gradual increase in diameter downwards to assist assembling of the floats into a larger platform. The lower end of each connecting hole 20 and the upper end of each connecting hole 21 have countersinks 24, 25, respectively, lest the connecting pins 23 should project from the upper or lower surface of the assembled floating structure. Each connecting pin 23 is so shaped as to be inserted with ease into the connecting holes in alignment, with the lower part tapered toward the bottom and the upper part having a back taper downwardly to be complementary in configuration to the holes 20, 21, respectively. The lower part of the pin is formed with a plurality of straight vertical grooves 26. The upper and lower end portions of each connecting pin 23 are externally threaded at 27, 28 for engagement with threads 30 formed on the inner wall of caps 29, 29 when the caps are screwed in place.

Assembling the plurality of floats 10, connecting pins 23, and caps 29 into a floating structure is done in the following way. First, connecting pins 23 are inserted into the connecting holes 20 in the lower extension 14 (or 15) of a given float 10. The tapers of the connecting pins and holes permit them to be simply set in preselected relative position. Lower caps 29 are fixed in position by screwing onto the external threads 27 on the lower end portions of the pins. Next, the upper extension 16 (or 17) of another float 10 is superposed on the above sub-assembly, as shown in FIG. 4, with the upper end of each connecting pin 23 fitted in the connecting hole 21 of the upper extension. At this time, the taper of the connecting pin and that of the connecting hole serve as guides for the engagement. Lastly, a cap 29 is secured in position by screwing onto the external thread 28 of the pin. This procedure is repeated until a desired number of floats have been joined likewise to complete the assembling of a final floating structure.

With the construction described above, the floating structure according to the present invention has little possibility of stress concentrations in the joints due to waves or changes in loads, the stresses being dispersed among the outward extensions. The joints, flexible to some extent with respect to swells of the water surface and changes in loads, are not subject to excessive stresses. Moreover, they provide practically gap-free, stable flat platforms. The connecting pins, made separate from the float body, are kept off the concentration of stresses and can have extended life. The simplicity of replacement makes the connecting pins easy to repair. Further, the sand that may intrude into the overlapping parts of the floats can be easily removed through the vertical grooves 26, and therefore the floats are protected against the shortening of life due to abrasion with sand.

What is claimed is:

1. A floating structure comprising a plurality of floats and connecting pins adapted to be fitted into connecting holes formed in the floats, each said float having a flat, polygonal shape, with upper and lower half parts staggered horizontally a given distance relative to each other, at least one edge forming an overhanging upper extension and an opposite edge forming a lower extension, said upper and lower extensions being formed with connecting holes which, when the float is arranged to overlap with floats of the same construction in a mutually complementary manner, come in alignment with connecting holes of the lower and upper extensions of the neighboring floats so that said connecting pins are inserted through the holes and wherein at least one of the connecting holes and the connecting pins are each formed with axially extending said-escape grooves.

2. A floating structure according to claim 1 in which the connecting holes formed in the lower extensions each have a downward taper and the connecting pins each have a corresponding taper.

3. A floating structure according to claim 1 in which the connecting holes formed in the overhanging upper extensions each have an upward taper and the connecting pins each have a corresponding taper.

4. A floating structure according to claim 1 in which the floats and connecting pins are made of polyethylene such as crosslinked polyethylene.

* * * * *